United States Patent [19]

Takita et al.

[11] Patent Number: 4,881,831

[45] Date of Patent: Nov. 21, 1989

[54] PRINTER

[75] Inventors: Masaaki Takita, Ibaraki; Yoshikazu Tsuru, Hirakata; Toshiharu Kitagawa, Katano; Yoshikazu Nomura, Osaka, all of Japan

[73] Assignee: Matsushita Electric Industrial Co., Ltd., Osaka, Japan

[21] Appl. No.: 155,098

[22] Filed: Feb. 11, 1988

[30] Foreign Application Priority Data

Feb. 18, 1987 [JP] Japan ..... 62-35033
Feb. 18, 1987 [JP] Japan ..... 62-35036

[51] Int. Cl.[4] ..... B41J 3/02

[52] U.S. Cl. ..... 400/120; 400/617; 400/618; 400/619

[58] Field of Search ..... 400/120, 656, 617, 618-619, 400/208, 211; 346/76 PH, 134, 146

[56] References Cited

U.S. PATENT DOCUMENTS

| | | | |
|---|---|---|---|
| 4,327,366 | 4/1982 | Schafter et al. | 400/120 |
| 4,668,961 | 5/1987 | Hiramatsu | 400/120 |
| 4,693,620 | 9/1987 | Harumatsu | 400/636 |
| 4,698,650 | 10/1987 | Watanabe et al. | 400/625 |
| 4,738,555 | 4/1988 | Nagashima | 400/120 |
| 4,750,006 | 6/1988 | Hashimoto | 346/134 |
| 4,769,103 | 9/1988 | Koiki et al. | 400/120 |

*Primary Examiner*—E. N. Eickholt
*Attorney, Agent, or Firm*—Stevens, Davis, Miller & Mosher

[57] ABSTRACT

The present invention relates to a printer which is capable of eliminating the slack of paper, wherein, at the time of printing, the paper is fed by a pinch roller, while, at the time of paper feeding, the paper is caused to slide relatively at least on a platen roller.

3 Claims, 6 Drawing Sheets

PRINTER

BACKGROUND OF THE INVENTION

1. Field of the Invention

The present invention relates to a printer.

2. Description of the Prior Art

FIG. 1 is an exploded perspective view of a conventional heat transfer color printer. As shown in the drawing, the conventional heat transfer color printer comprises the following components or portions: a lower cabinet 1; a circuit portion 2; a power supply panel 3; a pinch roller 4; a capstan roller 5, against which the pinch roller 4 is adapted to abut to impart a driving force to the same; a platen roller 6, which, together with the pinch roller 4 and the capstan roller 5, constitutes a paper feeding mechanism; a main motor 7 for driving the pinch roller 4 and the platen roller 6; a pinch lever 8 adapted to be interlinked with the movement of a cam to cause the pinch roller 4 to be brought into contact with the capstan roller 5 or to cancel the contact thereof; a release roller 9 for releasing an ink film from paper; a paper feed roller 10 for bringing the paper into contact with the platen roller 6; a paper guide 11 for guiding the paper; and a paper support 12 for supporting the paper wound in the form of a roll. The printer further comprises a cover frame 13; a lock lever 14; a lock lever shaft 15, which engages or disengages with the lock lever 14 to open or close the cover frame 13; a ribbon feed gear 16 disposed on the cover frame 13 and adapted to effect positioning of one end of a ribbon feed; a ribbon holder 17 similarly disposed on the cover frame 13 and adapted to impart a pressing force against the other end of the ribbon feed; a head holder 18; a head 19 secured to the head holder 18; a head arm 20 which is interlinked with the operation of a cam and to which the head 19 is secured; a cooling fan 21 for radiating heat from the main motor 7, the circuit portion 2, and the like; an operation panel 22; a top cover 23; and an upper cabinet 24.

In the conventional heat transfer color printer, the paper feeding and printing are carried out in the manner illustrated in FIGS. 2*a* and 2*b*.

At the time of printing, as shown in FIG. 2*b*, paper 25 is gripped by the capstan roller 5 and the pinch roller 4 and rotates in the direction of the arrow B. At this time, the head 19 is pressed by the platen roller 6, which races clockwise by means of a one-way clutch (not shown in this drawing) and is rotated by the paper 25 only by an amount of feeding by the capstan roller 5.

Meanwhile, at the time of paper feeding, as shown in FIG. 2*a*, the capstan roller 5 and the pinch roller 4, while gripping the paper, rotate in the direction of the arrows a, b. At this time, the head 19 is located at a position spaced apart from the platen roller 6, and the paper 25 is gripped by the platen roller 6 and the paper feed roller 10 and is driven counterclockwise by the one-way clutch by means of the platen roller 6 which is connected with the capstan roller 5 via gears.

Incidentally, yellow magenta, and cyan are arranged on an ink film 27 sequentially for each image plane, and the above-described operation is repeated three times to effect color printing.

However, with the arrangement shown in FIGS. 2*a* and 2*b*, at the time when the paper 25 is set between the platen roller 6 and the pinch roller 4, if the paper 25 is set diagonally with respect to the direction A or B, or if it is set with the paper 25 slackened between the pinch and capstan rollers 4, 5 on the one hand, and the platen roller 6 on the other, the state of the diagonal setting and slackening of the paper 25 remain as they are since both the platen roller 6 and the pinch roller 4 are rotatively driven at the time of paper feeding and printing. For this reason, when printing is effected, there has been a drawback in that diagonal printing and misalignment of printing can occur.

SUMMARY OF THE INVENTION

Accordingly, the object of the present invention is to provide a heat transfer color printer having a paper advancing mechanism which is capable of positively eliminating the slackness of paper between a capstan roller and a platen roller at the time of paper feeding and produces a small degree of misalignment of printing.

To this end, in accordance with the present invention, there is provided a printer comprising: a capstan roller, a pinch roller provided in correspondence with the capstan roller; a head for applying heat to an ink film; a platen roller provided with sliding friction; and a paper feed roller disposed in correspondence with the platen roller, wherein, during printing, the paper is fed by the pinch roller, and, during paper feeding, the paper is fed by the pinch roller and the platen roller and is caused to slide relatively over the platen roller.

DESCRIPTION OF THE PREFERRED EMBODIMENTS

The present invention is arranged such that, during printing, the paper is fed by a pinch roller, and during paper feeding the paper is fed at least by a platen roller, and the paper is caused to slide relatively over the platen roller. Therefore, when an uneven slack has occurred between the right- and left-hand sides of the paper between a capstan roller and the platen roller, any slack of the paper is eliminated by causing the paper to slide over the platen roller during paper feeding.

Referring now to the accompanying drawings, description will be given of the preferred embodiments of the present invention.

Embodiment 1

Figure 1:
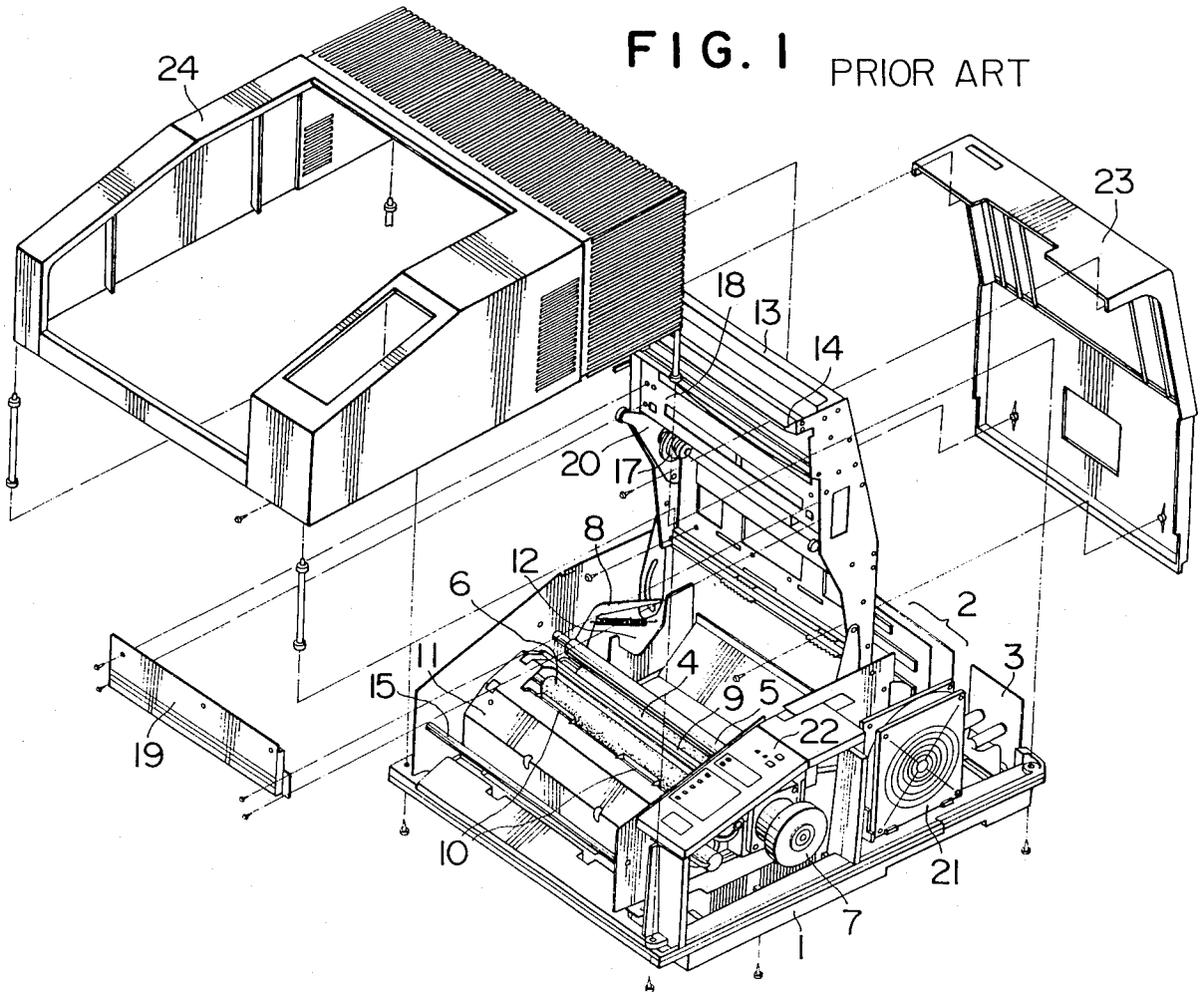
FIG. 1 PRIOR ART
FIG. 1 is an exploded perspective view of a conventional heat transfer color printer.
Figure 2A:
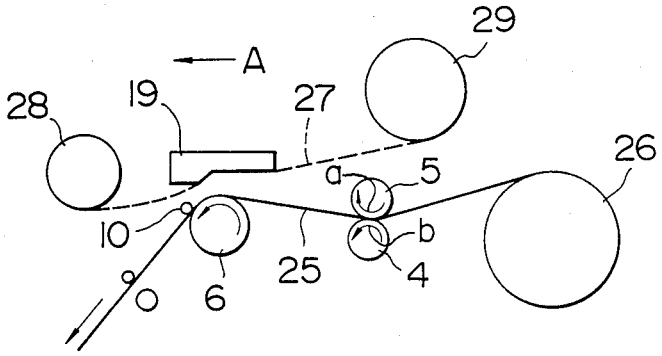
FIG. 2a PRIOR ART
FIGS. 2*a*, 2*b*, 3*a* and 3*b* are diagrams schematically illustrating paper feeding and printing mechanisms.
Figure 2B:
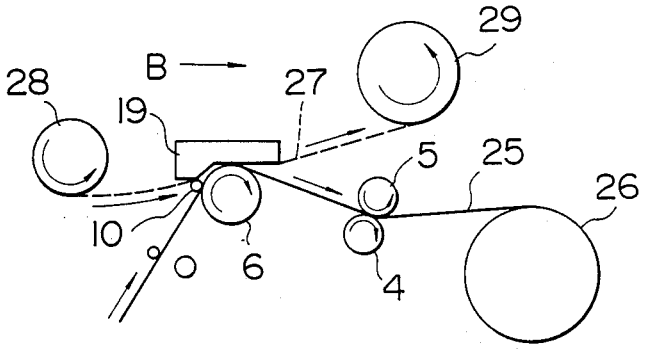
FIG. 2b PRIOR ART
Figure 3A:
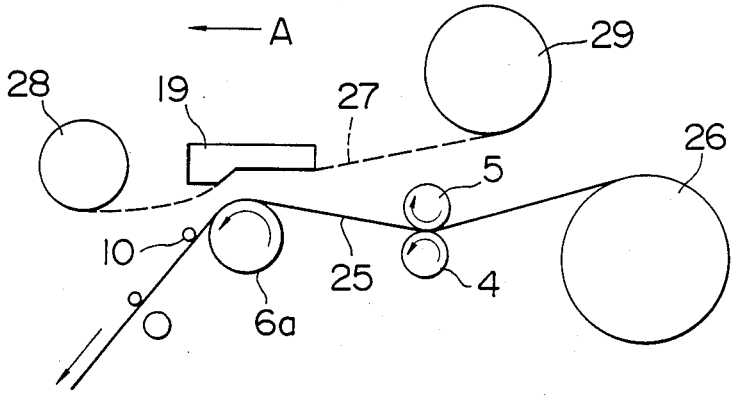
Figure 3B:
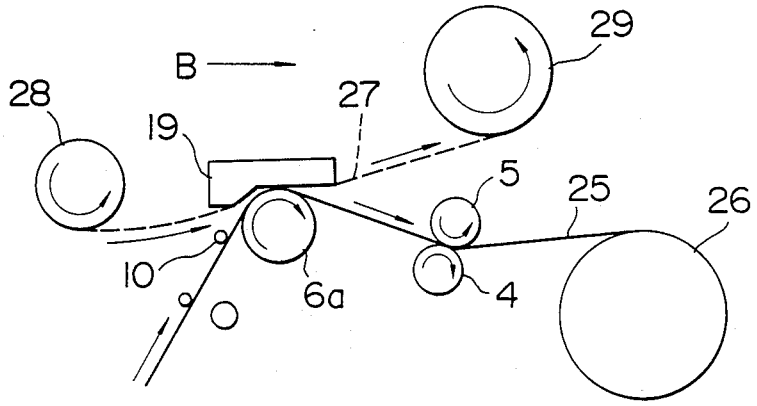

FIGS. 3*a* and 3*b* are diagrams schematically illustrating paper feeding and printing sections of a printer in accordance with a first embodiment of the present invention.

First, at the time of paper feeding, as shown in FIG. 3*a*, the paper 25 is fed by an amount corresponding to one image plane from the paper holder 26 in the direction of the arrow A by the counterclockwise rotational driving forces of the pinch roller 4 and a platen roller 6a. At this time, the head 19 is located at a position away from the platen roller 6a, and the ink film 27 remains stopped, and printing is not effected. In order to prevent the slack of the paper between the capstan roller 5 and the platen roller 6a, the outside diameter of the platen roller 6a is made greater than a theoretical value by a very small amount, and the platen roller 6a is thereby adapted to feed the paper by an amount several millimeters greater than an amount of feeding by the capstan roller 5.

In addition, in this embodiment, the platen roller 6a is so arranged that its surface has a lower coefficient of sliding friction than that of the conventional platen roller 6, and there is provided a paper feed roller for bringing the paper into contact with the platen roller 6a at a fixed winding angle. For this reason, the surface of the platen roller 6a is coated with a Teflon-based resin material.

Incidentally, in FIG. 3a, reference numeral 28 denotes an ink film holder, while numeral 29 denotes an ink film takeup holder.

At the time of printing, as shown in FIG. 3b, the platen roller 6a and the pinch roller 4 rotates clockwise, and the paper 25 is unwound by the amount of one image plane in the direction of the arrow B. At this time, the head 19 is in contact with the platen roller 6a, the ink film holder 28 and the ink film takeup holder 29 rotate counterclockwise, and the ink film 27 is unwound in the direction of the arrow B. Subsequently, heat is applied from the head 19 to the ink film 27, and predetermined printing is effected on the paper 25.

Yellow, magenta, and cyan are arranged sequentially within each image plane, and color printing is carried out by repeating the above-described operation three times.

Figure 4A:
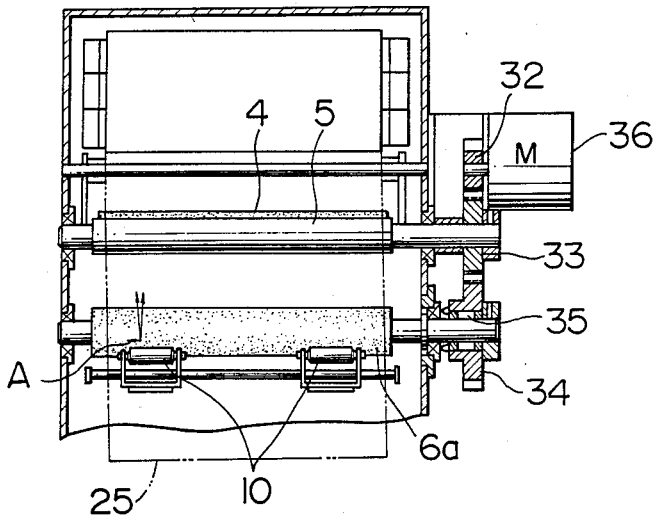
FIGS. 4*a* and 4*b* are top plan views illustrating a paper slack correcting mechanism.
Figure 4B:
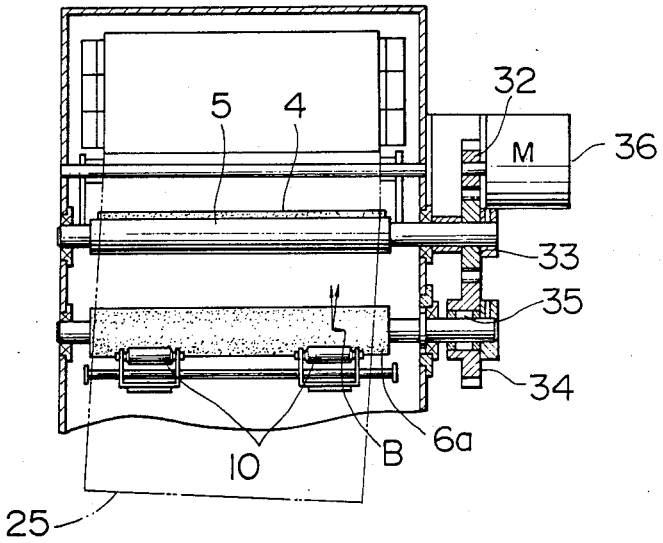

FIGS. 4a and 4b are top plan views schematically illustrating a heat transfer color printer in accordance with an embodiment of the present invention.

First, the paper 25 is fed forward while being clamped by the pinch roller 4 and the capstan roller 5. At this time, the platen roller 6a is rotated by a oneway clutch 35 in synchronization with the capstan roller 5 via gears 32, 33 and 34, and the amount of the paper 25 fed by the platen roller 6a is greater than that fed by the pinch roller 4 and the capstan roller 5 by a portion in which the diameter of the platen roller 6a is made greater. A pressing force of the paper feed roller 10 acting on the paper 25 helps to feed the paper 25 further by applying tension thereon. The slack of the paper 25 due to slippage of the paper 25 over the platen roller 6a is thereby eliminated. Subsequently, the head 19 is brought into contact with the platen roller 6a, and as the motor 36 is rotated reversely, the paper 25 is fed backward while being pinched between the capstan roller 5 and the pinch roller 4, and printing is then carried out.

In this embodiment, by virtue of the abovedescribed arrangement, as shown in FIG. 4a, if a greater amount of slack has occurred on the right-hand side, as viewed in the drawing, between the capstan roller 5 and the platen roller 6a, the tension on the left-hand side becomes greater than that on the right-hand side. Accordingly, a component force A is generated in the direction of the left-hand side by the tension acting on the left-hand side of the paper 25, and the paper 25 is thereby pulled leftwardly until the slack of the paper 25 is eliminated. In addition, if a greater amount of slack has occurred on the left-hand side, as shown in FIG. 4b, the paper 25 is pulled rightwardly by a component force B until its slack of the paper is eliminated, and its slack is thus corrected. Hence, the correction of the track of the paper 25 is effected by allowing the paper 25 to be slid on the platen roller 6a.

As has been described above, in accordance with this embodiment, since it is possible to correct the slack of the paper resulting from a degree of nonparallelism of the paper between the rollers, printing is always effected in a favorable state, so that it is possible to provide a high-quality printer.

Embodiment 2

In the case of the above-described embodiment 1, it is impossible to correct a large degree skew (meandering) which occurs when the paper 25 is mounted. Therefore, in this embodiment, an arrangement is provided to allow a large degree skew to be corrected first and a small degree skew to be corrected afterwards.

Figure 5A:
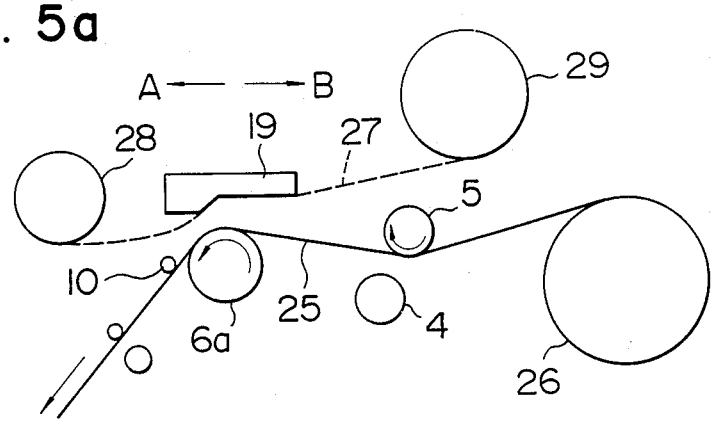
FIGS. 5*a*, 5*b* and 5*c* are diagrams schematically illustrating the operation of paper-feeding and printing mechanisms of the heat transfer color printer.
Figure 5B:
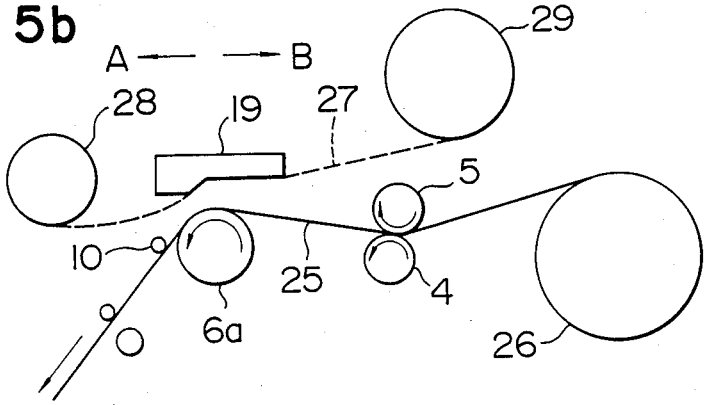
Figure 5C:
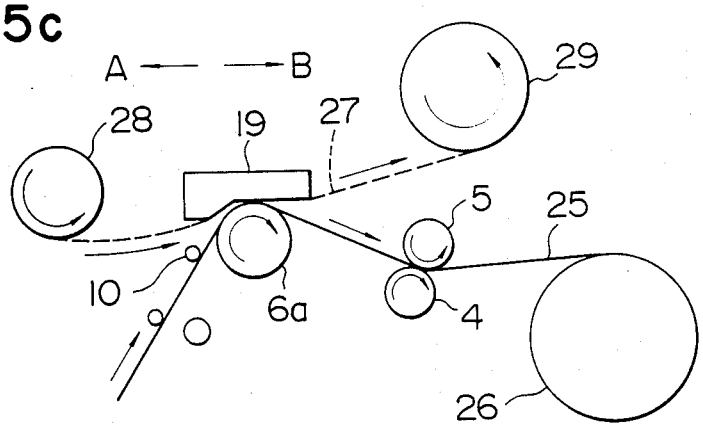

FIGS. 5a, 5b and 5c are diagrams schematically illustrating the operation of paper feeding and printing sections of the heat transfer color printer in accordance with this embodiment.

First, at the time of the primary paper feeding for correcting a large degree skew, as shown in FIG. 5a, the pinch roller 4 is located away from the capstan roller 5, and no driving force is imparted to the paper 25 by the pinch roller 4. Consequently, the paper 25 is fed about by an amount corresponding to one fourth of the image plane in the direction of the arrow A by the counterclockwise rotation of the platen roller 6a alone. If the paper 25 is substantially inclined toward, for instance, the right-hand side with respect to the direction of the arrow A, the tension between the platen roller 6 and the paper holder 26 i the direction of the arrow B is greater on the left-hand side with respect to the direction of the arrow A than on the right-hand side. Accordingly, as the platen roller 6a rotates, the paper 25 slidingly moves toward the left-hand side from the right-hand side with respect to the direction of the arrow A in the axial direction of the platen roller 26. The correction of the track of the paper 25 is thus carried out. In addition, even if the paper 25 is set with a slack, it is possible to eliminate the slack on the above-described principle.

During the secondary paper feeding for correcting a small degree skew, as shown in FIG. 5B, the pinch roller 4 moves to a position at which it is brought into contact with the capstan roller 5, and the paper 25 is fed about by three fourths of the image plane in the direction of the arrow A, and the feeding operation of the paper 25 is thereby completed. At this time, the correction described in Embodiment 1 is carried out.

During printing, in the same way as the conventional example, the paper 25 and the ink film 27 are unwound by one image plane in the direction of the arrow B, and printing on one image plane is effected in the meantime (see FIG. 5C).

Yellow, magenta, and cyan are arranged on the ink film 27 sequentially on each image plane, and color printing is effected by repeating the above-described operation three times. Accordingly, since, upon starting of each paper feeding, the operation shown in FIG. 5A is carried out, the track of the paper 25 is corrected on each such occasion. Therefore, printing is always effected in a favorable condition. In particular, since the slack of the paper 25 is caused by the nonuniformity of the diameter of the capstan roller 5, nonuniform pressing, uneven urging forces of springs disposed at opposite ends of the paper holder 26, shrinkage of the paper, or the like, the fact that the paper track is corrected on the occasion of each printing bears a significant meaning.

Figure 6A:
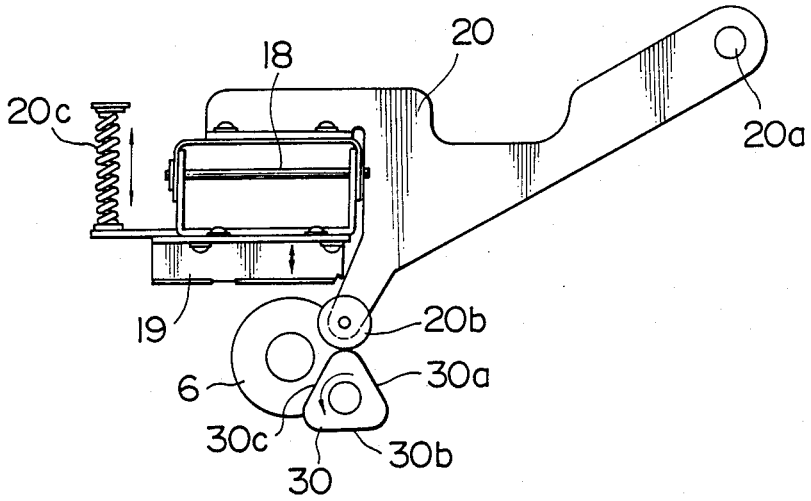
FIGS. 6*a* and 6*b* are diagrams schematically illustrating a head updown mechanism for realizing the operation shown in FIGS. 5*a*, 5*b* and 5*c* and a pinch roller opening and closing mechanism.
Figure 6B:
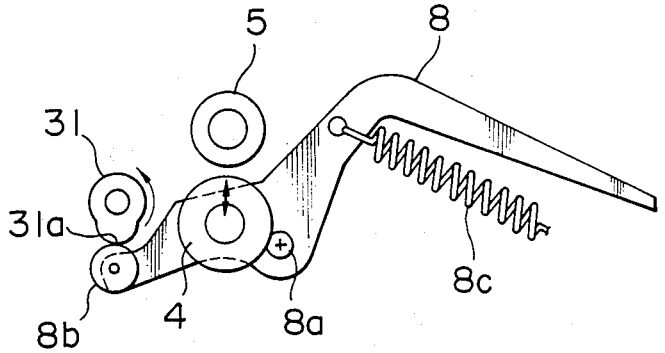

Referring now to FIGS. 6*a* and 6*b*, description will now be made of the operation of the lever and the cam which control the operation of the pinch roller 4 and the head 19.

FIG. 6*a* is a diagram schematically illustrating a head updown mechanism.

As is apparent from the drawing, by virtue of the counterclockwise rotation of a cam 30 and the action of a head holding spring 20*c*, the head arm 20 which traces the cam 30 by means of a roller 20*b* moves vertically with a fulcrum 20*a* as its center, so as to move the head 19 vertically. Namely, the head 19 is brought into contact with the platen roller 6 when the roller 20*b* traces each point 30*a*, 30*b* and 30*c* of the cam 30. In other words, the point 30*a* corresponds to yellow printing, the point 30*b* to magenta printing, and the point 30*c* to cyan printing, respectively.

FIG. 6*b* is a diagram schematically illustrating a pinch roller opening and closing mechanism. As is apparent from the drawing, by virtue of the counterclockwise rotation of a cam 31 and the action of a spring 8*c*, the pinch lever 8 which traces the cam 31 by means of a roller 8*b* moves vertically with a fulcrum 8*a* as its center, and the gap between the pinch roller 4 and the capstan roller 5 is thereby opened and closed. Namely, the gap between the pinch roller 4 and the capstan roller 5 is opened at a point 31*a*, but is closed at the other points.

The cams 30 and 31 are adapted to rotate concentrically, and each operation shown in FIGS. 6*a* and 6*b* is effected simultaneously in conjunction with the rotation of the cams 30, 31, and the operations described with reference to FIGS. 5*a*, 5*b* and 5*c* are performed.

Although, in the above-described embodiment, the operation is effected by means of a cam mechanism, it goes without saying that it is possible to realize the operations shown in FIGS. 5*a* to 5*c* even if, for instance, a solenoid or the like is used.

As has been described above, in accordance with the present invention, since the correction of the track of the paper can be performed in advance of printing, printing is always carried out in a favorable condition, so that it is possible to provide a high-quality heat transfer printer.

What is claimed is:

1. A printer for use with an ink film comprising:

a capstan roller;

a pinch roller provided in correspondence with said capstan roller;

a paper supply means arranged upstream of said capstan roller and said pinch roller;

a printing head for applying heat to an ink film to be interposed between said printing head and paper to be printed;

a platen roller provided with sliding friction, said capstan roller and said pinch roller clamping therebetween a paper to be printed fed from said paper supply means and feeding it to said platen roller; and, a paper feed roller disposed in correspondence with said platen roller, wherein said pinch roller and said capstan roller are disposed upstream of said paper feed roller and said platen roller but downstream of said paper supply means so as to apply a back tension to the paper during printing, while the paper is fed by said pinch roller, said capstan roller, said platen roller and said paper feed roller so as to cause the paper to slip on said platen roller, relative to said platen roller during paper feeding.

2. A printer according to claim 1, wherein an amount of the paper fed by said platen roller is greater than that fed by said capstan roller.

3. A printer according to claim 1, wherein said platen roller is coated with a Teflon-based resin.

* * * * *